US010369428B2

(12) United States Patent
Motokawa et al.

(10) Patent No.: US 10,369,428 B2
(45) Date of Patent: Aug. 6, 2019

(54) GOLF CLUB HEAD

(71) Applicant: DUNLOP SPORTS CO. LTD., Kobe-shi, Hyogo (JP)

(72) Inventors: Yuki Motokawa, Kobe (JP); Daisuke Kohno, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/854,279

(22) Filed: Dec. 26, 2017

(65) Prior Publication Data

US 2018/0178089 A1 Jun. 28, 2018

(30) Foreign Application Priority Data

Dec. 27, 2016 (JP) ..... 2016-252271

(51) Int. Cl.
*A63B 53/04* (2015.01)

(52) U.S. Cl.
CPC .. *A63B 53/0466* (2013.01); *A63B 2053/0437* (2013.01); *A63B 2053/0458* (2013.01); *A63B 2209/02* (2013.01)

(58) Field of Classification Search
USPC ..... 473/324–350
See application file for complete search history.

(56) References Cited

U.S. PATENT DOCUMENTS 4,021,047 A * 5/1977 Mader ..... A63B 53/04 473/345
6,875,126 B2 * 4/2005 Yabu ..... A63B 53/0466 473/305
6,945,876 B2 * 9/2005 Nakahara ..... A63B 53/0466 473/329
6,969,326 B2 * 11/2005 De Shiell ..... A63B 53/0466 473/345
7,037,214 B2 * 5/2006 Nakahara ..... A63B 53/04 473/345
7,175,541 B2 * 2/2007 Lo ..... A63B 53/0466 273/DIG. 14

(Continued)

FOREIGN PATENT DOCUMENTS

JP 2003-250935 A 9/2003

*Primary Examiner* — Alvin A Hunter
(74) *Attorney, Agent, or Firm* — Birch, Stewart, Kolasch & Birch LLP

(57) ABSTRACT

A golf club head with a hollow therein includes a head main body and a crown member. The head main body includes a face portion having a hitting face, a crown portion provided with an opening and a peripheral region forming around the opening, wherein the opening is covered with the crown member. The peripheral region of the opening includes a mounting portion for mounting the crown member with an interior surface and an exterior surface thereof. The mounting portion, at least, includes a face-side mounting portion, a toe-side mounting portion and a heel-side mounting portion. The crown member includes a face-side peripheral portion fixed to the interior surface of the face-side mounting portion, a toe-side peripheral portion fixed to the exterior surface of the toe-side mounting portion and a heel-side peripheral portion fixed to the exterior surface of the heel-side mounting portion.

17 Claims, 11 Drawing Sheets

(56) References Cited

U.S. PATENT DOCUMENTS

| | | | | |
|---|---|---|---|---|
| 7,252,599 | B2 * | 8/2007 | Hasegawa | A63B 53/0466 473/329 |
| 7,371,191 | B2 * | 5/2008 | Sugimoto | A63B 53/0466 473/345 |
| 7,559,853 | B2 * | 7/2009 | Hirano | A63B 53/0466 473/324 |
| 7,699,719 | B2 * | 4/2010 | Sugimoto | A63B 53/04 473/345 |
| 7,749,103 | B2 * | 7/2010 | Nakano | A63B 53/0466 473/345 |
| 7,762,909 | B2 * | 7/2010 | Sugimoto | A63B 53/0466 473/346 |
| 2005/0209024 | A1 * | 9/2005 | Oyama | A63B 53/0466 473/347 |

* cited by examiner

GOLF CLUB HEAD

BACKGROUND ART

Field of the Invention

The present disclosure relates to golf club heads, and more particularly to a hollow golf club head including a head main body and a crown member which are joined with each other.

Description of the Related Art

Recently, golf club heads which are configured by joining a plurality of members with different specific gravity have been proposed in order to improve various performances. This kind of typical golf club head, for example, may include a head main body having a crown portion provided with an opening and a crown member joined to the head main body to close the opening. When the crown member, for example, is configured by a low specific gravity material, a low center of gravity of the club head can be brought.

As related art, a golf club head as such is disclosed in Japanese Patent Application Publication No. 2003-250935.

SUMMARY OF THE INVENTION

In the golf club head as described above, when the crown member is made of a material which is not able to weld to the head main body, the crown member, for example, may be joined to the head main body using an adhesive agent. Unfortunately, since joining using an adhesive agent has joining strength less than that of welded joints, such a golf club head may result in low durability. In particular, the crown portion of the golf club head tends to deform elastically largely on the side of the hitting face thereof when impacting a ball. Thus, since a front side portion of the crown member which joined to the head main body receives large impact force, there was a possibility that the crown member would be separated easily from the head main body.

The present disclosure has been made in view of the above problems in the conventional art, and has a main object to provide a golf club head having excellent durability by increasing joining strength between a head main body and a crown member.

In one aspect of the disclosure, a golf club head having a hollow therein, the golf club head includes a head main body and a crown member. The head main body includes a face portion having a hitting face for striking a ball and a crown portion provided with an opening and a peripheral region forming around the opening, wherein the opening is covered with the crown member. The peripheral region of the opening includes a mounting portion for mounting the crown member, and the mounting portion has an interior surface and an exterior surface. The mounting portion, at least, includes a face-side mounting portion extending in a toe-heel direction of the golf club head on a side of the face portion of the peripheral region, a toe-side mounting portion extending on a toe side of the golf club head of the peripheral region and located backwardly of the face-side mounting portion in a front-back direction of the golf club head and a heel-side mounting portion extending on a heel side of the golf club head of the peripheral region and located backwardly of the face-side mounting portion in the front-back direction of the golf club head. The crown member includes a face-side peripheral portion fixed to the interior surface of the face-side mounting portion, a toe-side peripheral portion fixed to the exterior surface of the toe-side mounting portion and a heel-side peripheral portion fixed to the exterior surface of the heel-side mounting portion.

In another aspect of the disclosure, the face-side mounting portion and the toe-side mounting portion may be continuous with each other.

In another aspect of the disclosure, the face-side mounting portion and the toe-side mounting portion may be continuous at a point (P1), the point (P1) may be located backwardly of an upper edge of the hitting face at a distance (D) in the front-back direction of the golf club head, and the distance (D) may be in a range of from 4% to 50% of a length (L) of the crown portion in the front-back direction of the golf club head.

In another aspect of the disclosure, the face-side mounting portion and the toe-side mounting portion may be continuous at a point (P1), the point (P1) may be located backwardly of an upper edge of the hitting face at a distance (D) in the front-back direction of the golf club head, and the distance (D) may be in a range of from 5 to 30 mm.

In another aspect of the disclosure, the face-side mounting portion and the heel-side mounting portion may be continuous with each other.

In another aspect of the disclosure, the face-side mounting portion and the heel-side mounting portion may be continuous at a point (P3), the point (P3) may be located backwardly of an upper edge of the hitting face at a distance (D) in the front-back direction of the golf club head, and the distance (D) may be in a range of from 4% to 50% of a length (L) of the crown portion in the front-back direction of the golf club head.

In another aspect of the disclosure, the face-side mounting portion and the heel-side mounting portion may be continuous at a point (P3), the point (P3) may be located backwardly of an upper edge of the hitting face at a distance (D) in the front-back direction of the golf club head, and the distance (D) may be in a range of from 5 to 30 mm.

In another aspect of the disclosure, the mounting portion may further include a back-side mounting portion extending on a back side of the golf club head of the peripheral region, the crown member may further include a back-side peripheral portion fixed to the exterior surface of the back-side mounting portion, and the face-side mounting portion, the toe-side mounting portion, the heel-side mounting portion and the back-side mounting portion may be continuous with each other in a loop manner.

In another aspect of the disclosure, a gap in the front-back direction of the golf club head may be formed either between the face-side mounting portion and the toe-side mounting portion or between the face-side mounting portion and the heel-side mounting portion.

In another aspect of the disclosure, the face-side peripheral portion may not be joined to the exterior surface of the face-side mounting portion, the toe-side peripheral portion may not be joined to the interior surface of the toe-side mounting portion, or the heel-side peripheral portion may not be joined to the interior surface of the heel-side mounting portion.

In another aspect of the disclosure, the crown member may include an internal corner portion with a corner point formed between the face-side peripheral portion and the toe-side peripheral portion, and the corner point may be placed substantially on the point (P1).

In another aspect of the disclosure, the crown member may include an internal corner portion with a corner point formed between the face-side peripheral portion and the heel-side peripheral portion, and the corner point may be placed substantially on the point (P3).

DESCRIPTION OF THE PREFERRED EMBODIMENTS

Some embodiments of the present disclosure will be explained below with reference to the accompanying drawings. Note that the following disclosure including embodiments as illustrated in figures is for the purpose of promoting an understanding of the principles of the invention, and is not intended to limit the scope of the invention.

Figure 1:
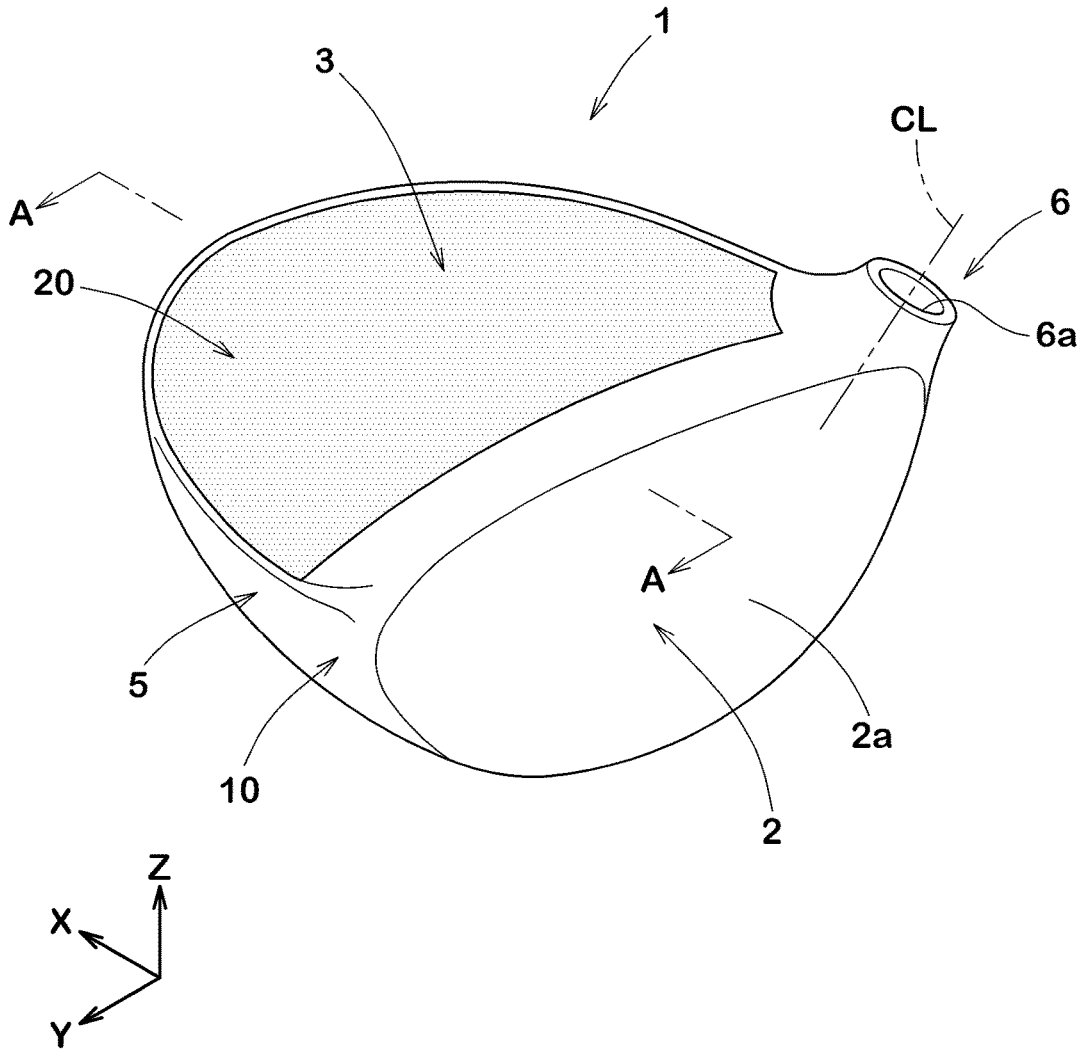
FIG. 1 is a perspective view of a golf club head in accordance with an embodiment.
Figure 2:
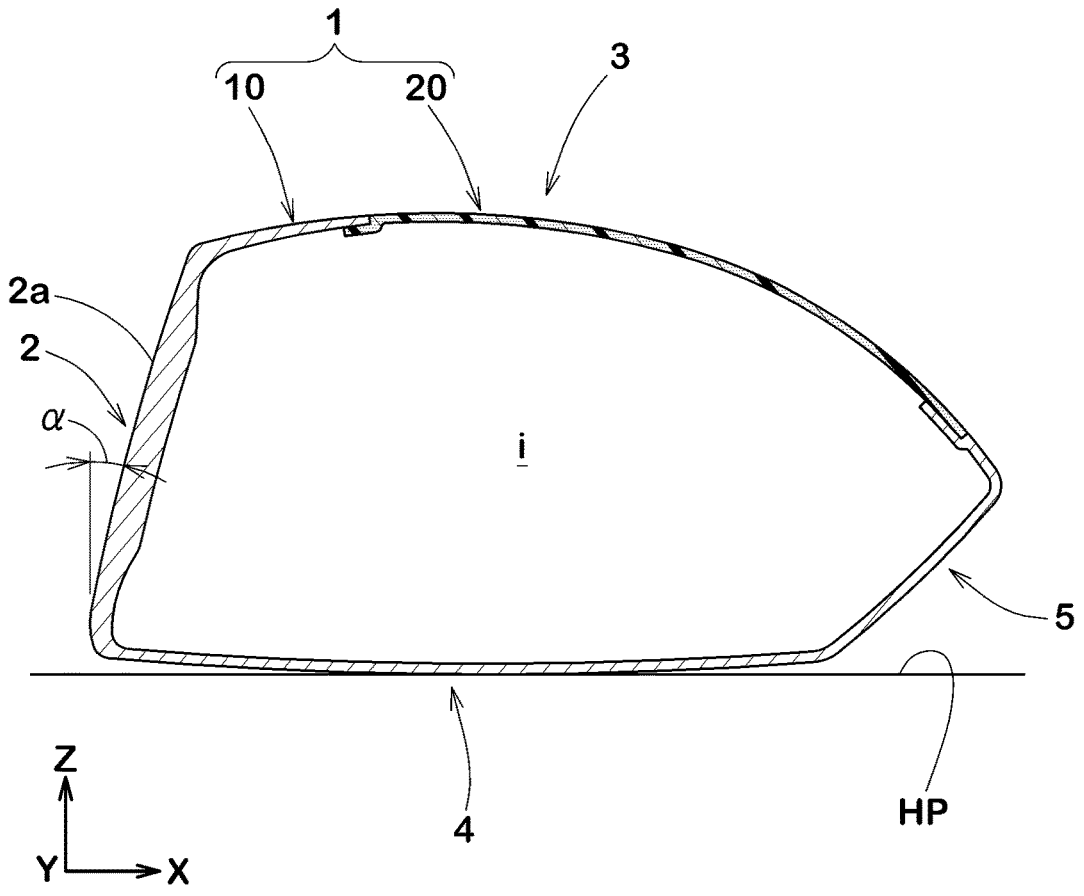
FIG. 2 is a cross-sectional view taken along lines A-A of FIG. 1.
Figure 3:
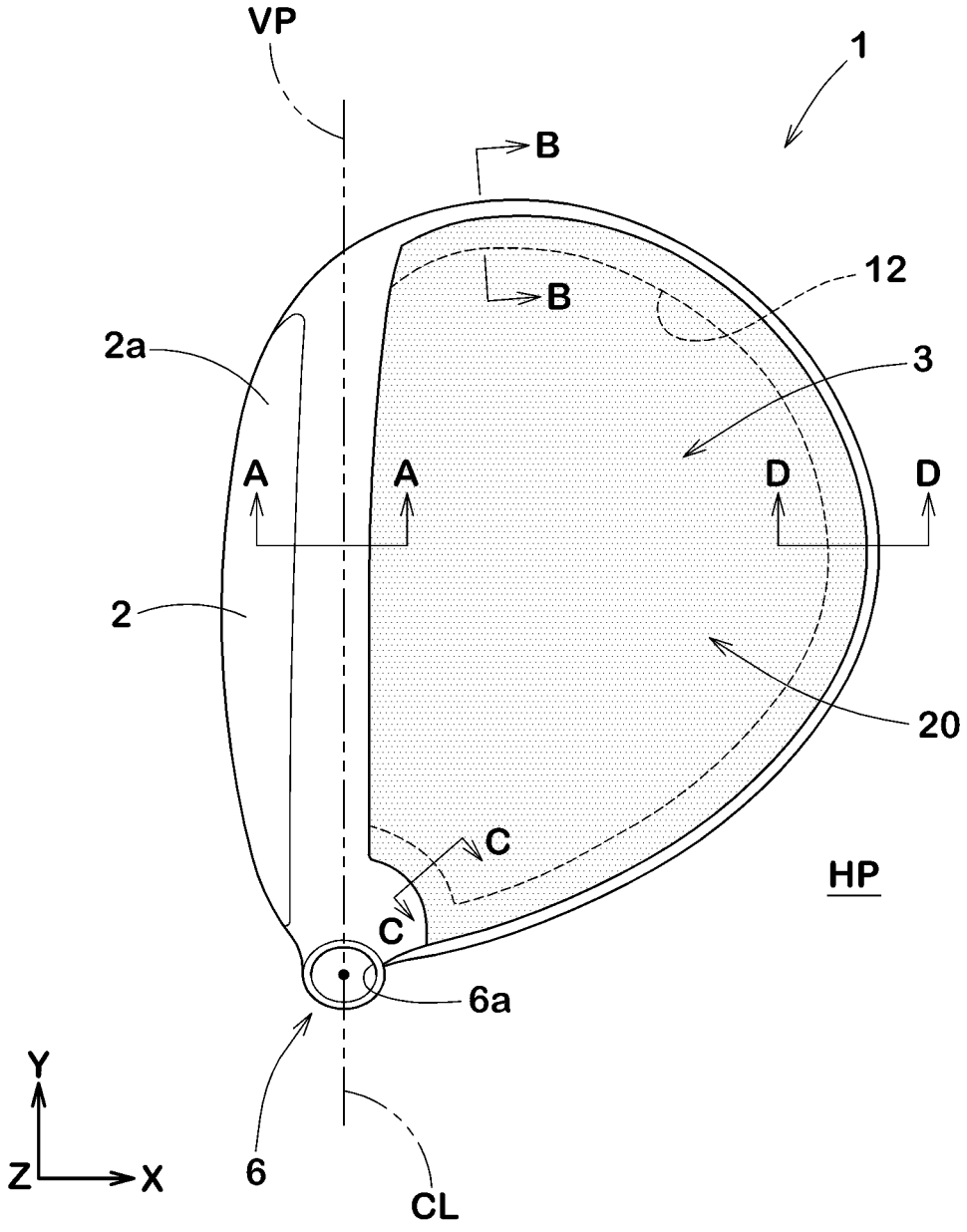
FIG. 3 is a plan view of the golf club head of FIG. 1.

FIG. 1 illustrates a perspective view of a golf club head 1 (hereinafter, may be simply referred to as the "head") in accordance with an embodiment, FIG. 2 illustrates a cross-sectional view of the head 1 taken along lines A-A of FIG. 1, and FIG. 3 illustrates a plan view of the head of FIG. 1. Further, FIGS. 1 to 3 illustrate the head 1 being placed under a standard state.

As illustrated in FIGS. 2 and 3, the standard state is a state where the head 1 is placed on a horizontal surface HP at a predetermined lie angle (not illustrated) and loft angle $\alpha$ (as illustrated in FIG. 2). In the standard state, the central axis CL of a club shaft is arranged within a vertical plane VP. In the standard state, a horizontal direction Y in parallel with the vertical plane VP is defined as a toe-heel direction of the head 1, and a horizontal direction X perpendicular to the vertical plane VP is defined as a front-back direction of the head 1. A vertical direction Z perpendicular to both directions X and Y is defined as an up and down direction of the head 1.

Referring to FIGS. 1 to 3, the head 1 in accordance with the embodiment is configured as a typical wood-type golf club head having a hollow i therein, for example. The wood-type means at least Driver (#1), Brassie (#2), spoon (#3), Buffy (#4) and Cleek (#5). In addition to the above, wood-type heads include heads having similar shapes to those of the heads listed above even if the club number and name are different from the above. As another embodiment, the head 1 may be configured as a utility-type head and iron-type head.

In this embodiment, the head 1, for example, includes a face portion 2, a crown portion 3, a sole portion 4 and a side portion 5.

The face portion 2 includes a front surface which constitutes a hitting face 2*a* for striking a ball. The crown portion 3 is continued from the face portion 2 to form an upper surface of the head. In this embodiment, the crown portion 3 is configured as a curve shape which protrudes upwardly smoothly. The sole portion 4 is continued from the face portion 2 to form a bottom surface of the head. The side portion 5 connects between the crown portion 3 and the sole part 4. The toe side end and the heel side end of the side portion 5 are connected to the face portion 2.

The crown portion 3 is provided in its heel side portion with a hosel portion 6, for example. The hosel portion 6 is configured as a tubular shape, and has a shaft inserting hole 6*a* into which the tip end of a club shaft (not shown) can be fixed. The central axis of the shaft insertion hole 6*a* corresponds to the central axis CL of the club shaft.

Figure 4:
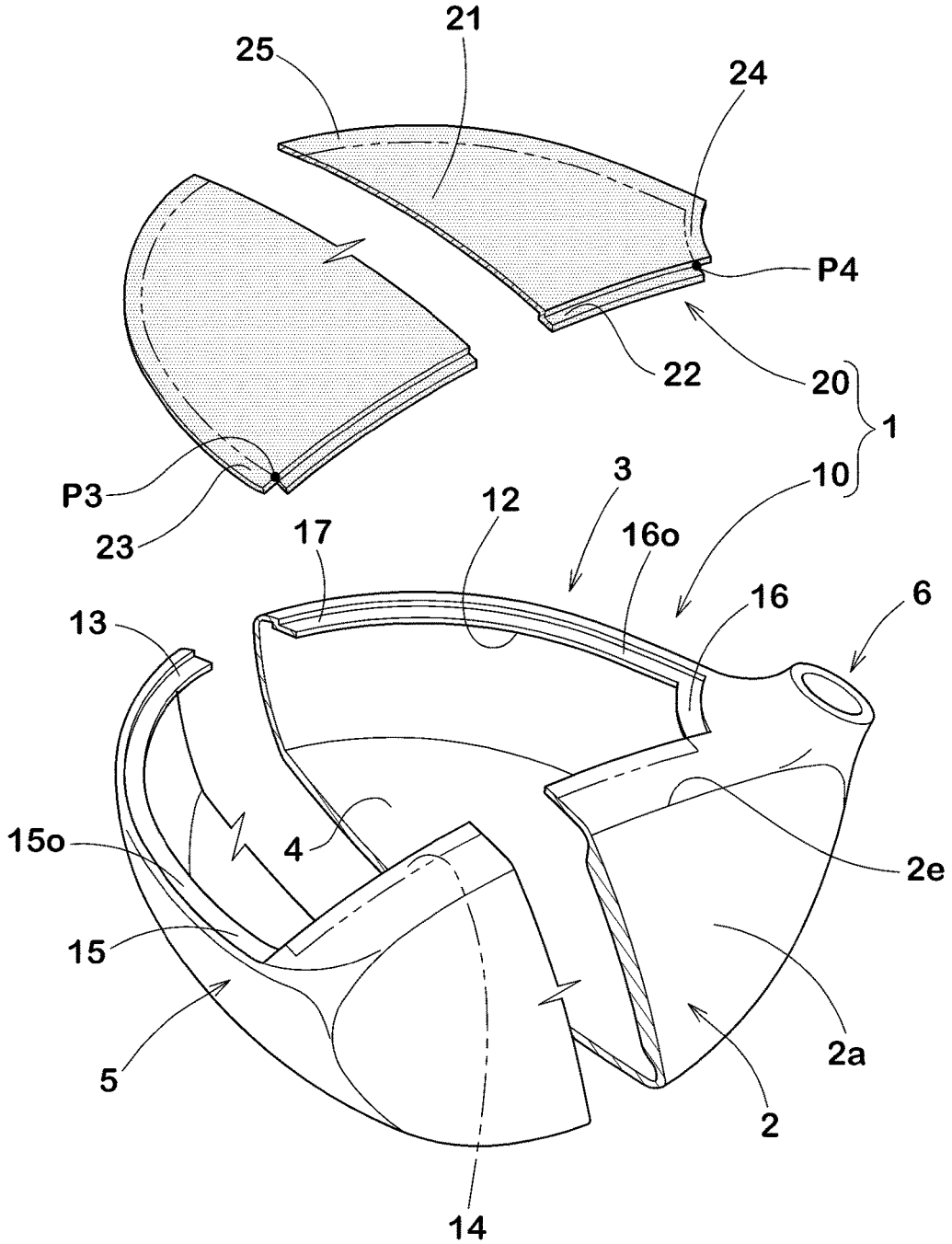
FIG. 4 is an exploded perspective view of the golf club head of FIG. 1.

FIG. 4 illustrates an exploded perspective view of the head 1 before assembling. As illustrated in FIG. 4, the head 1 in accordance with the embodiment includes a head main body 10 and a crown member 20.

The head main body 10, at least, includes the face portion 2 and the crown portion 3 provided with an opening 12. In some preferred embodiments, the head main body 10 further includes the sole portion 4, the side portion 5 and the hosel portion 6. In this embodiment, the head main body 10, for example, is made of a metallic material, and the above portions are integrally formed previously by casting and the like. As the metallic material for the head main body 1, for example, stainless steel (with specific gravity of approximately 7.6 to 8.0), titanium alloy (with specific gravity of approximately 4.5) and aluminum alloy (with specific gravity of approximately 2.7) can be preferably used. Note that the metallic material for the head main body 1 is not limited to the above specific material.

The opening 12 of the head main body 10 is closed by the crown member 20. In this embodiment, the crown member 20 is made of a material having a specific gravity smaller than that of the head main body 10. According to such an embodiment, the center of gravity of the head 1 may be lowered, since an upper side of the head 1 can be reduced in weight. This structure may be useful to offer a golf club head having a low sweet spot.

Figure 5B:
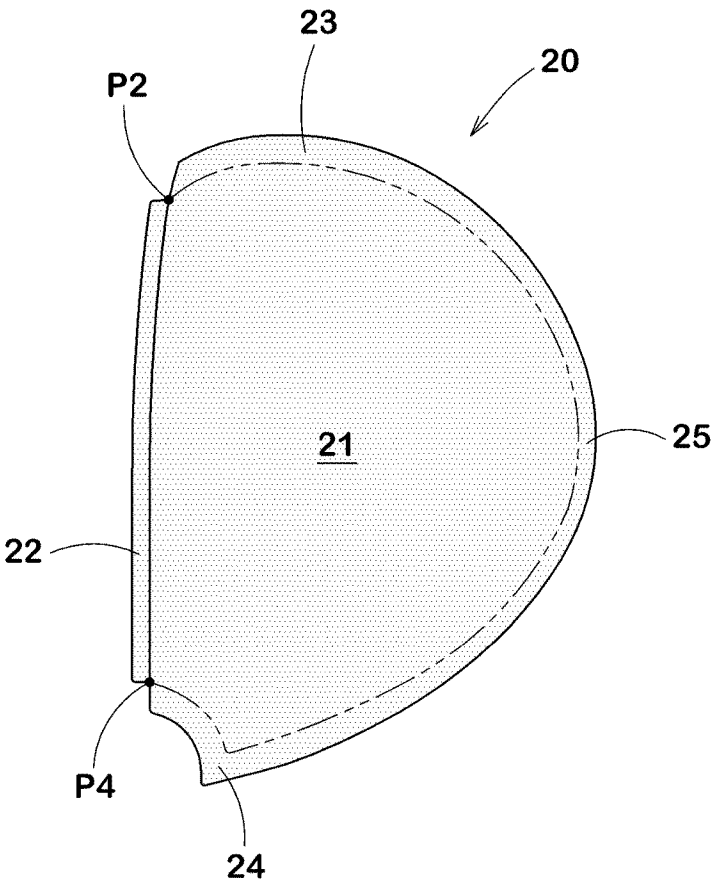
FIGS. 5A and 5B are plan views of a head main body and a crown member, respectively.
Figure 5A:
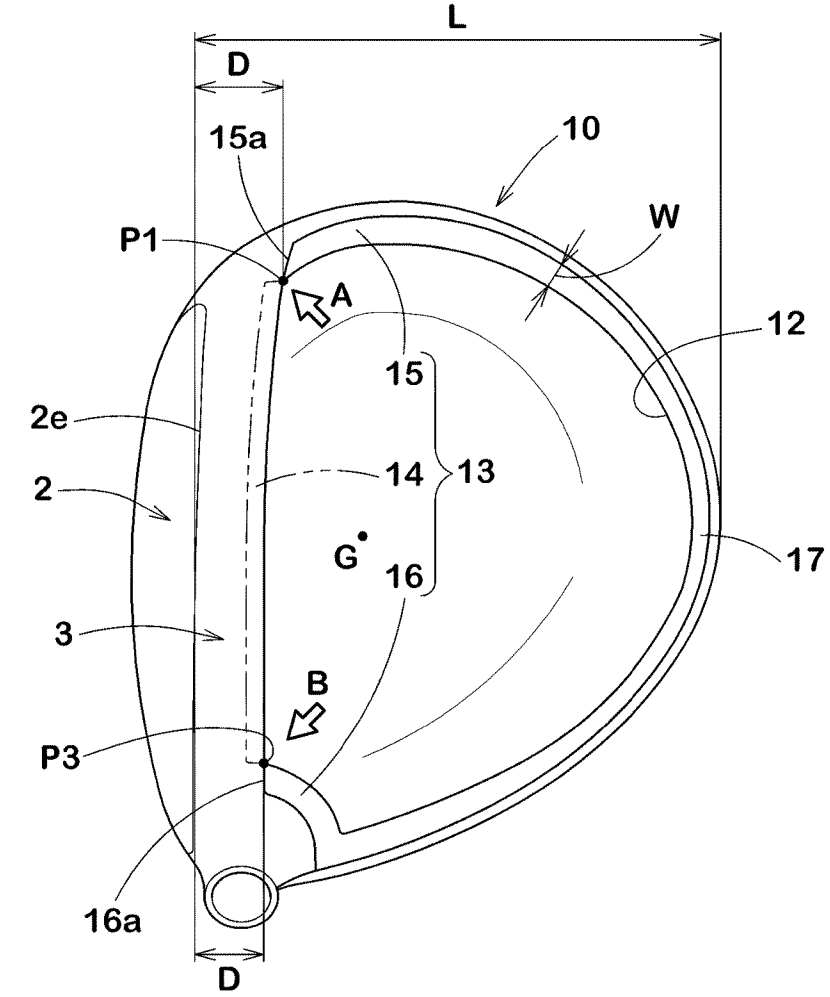

FIGS. 5A and 5B illustrate plan views of the head main body 10 and the crown member 20, respectively. As illustrated in FIG. 4 and FIG. 5A, the opening 12 of the head main body 10, for example, has an opening edge which extends approximately along the contour of the crown portion 3. In this embodiment, the opening 12 is disposed within the crown portion 3. In another aspect, a part of the opening 12, e.g., a back side thereof for example, may extend over the side portion 5 from the crown portion 3. In this aspect, a larger opening 12 can be offered, leading to further low center of gravity of the head 1. On the other hand, the opening 12 may preferably be arranged without reaching the face portion 2 so as not to disturb hitting a ball.

The head main body 10 includes a peripheral region of the opening 12, and the peripheral region includes a mounting portion 13 for mounting the crown member 20. In this embodiment, the mounting portion 13 at least includes a face-side mounting portion 14, a toe-side mounting portion 15 and a heel-side mounting portion 16.

The face-side mounting portion 14 is provided on a side of the face portion 2 of the peripheral region of the opening 12, and extends approximately in the toe-heel direction of the golf club head. In this embodiment, the face-side mounting portion 14 extends along (e.g., in parallel with) the upper edge 2*e* of the hitting face 2*a*. To help readers understanding, in FIGS. 4 and 5A, the boundary of a region of the face-side mounting portion 14 is illustrated using a two-dotted line. In this embodiment, the exterior surface of the face-side mounting portion 14 constitutes a finish up surface of the crown portion 3, for example.

The toe-side mounting portion 15 is located backwardly of the golf club head with respect to the face-side mounting portion 14 in the front-back direction of the head 1, and extends on a toe side of the peripheral region of the opening 12. In this embodiment, as illustrated in FIG. 4, an exterior surface 15*o* of the toe-side mounting portion 15, which faces the outside of the club head, constitutes a surface positioned lower than the finish up surface of the crown portion 3.

The heel-side mounting portion 16 is located backwardly of the golf club head with respect to the face-side mounting portion 14, and extends on a heel side of the peripheral region of the opening 12. In this embodiment, as illustrated in FIG. 4, an exterior surface 16*o* of the heel-side mounting portion 16, which faces the outside of the club head, constitutes a surface positioned lower than the finish up surface of the crown portion 3.

In this embodiment, the mounting portion 13, for example, includes a back-side mounting portion 17 located backwardly of the golf club head with respect to the face-side mounting portion 14, and extends on a back side of the peripheral region of the opening 12. In this embodiment, the mounting portion 13 is configured to be continuous from a front end 15*a* of the toe-side mounting portion 15 to a front end 16*a* of the heel-side mounting portion 16 through the back-side mounting portion 17.

As illustrated in FIG. 4 and FIG. 5B, the crown member 20 is configured as a thin plate shape, for example. In this embodiment, the crown member 20 is made of a fiber reinforced plastic. As the fiber reinforced plastic, for example, carbon-fiber reinforced plastic (CFRP), aramid-fiber reinforced plastic (AFRP), glass-fiber reinforced plastic (GFRP) and bron-fiber reinforced plastic and the like may be employed. In some another aspects of the disclosure, the crown member 20 may be made of a metallic material having a specific gravity smaller than that of the head main body 10. As the metallic material, for example, aluminum alloy (with specific gravity of approximately 2.7) and magnesium alloy (with specific gravity of approximately 1.8) may be employed.

The crown member 20 also include the contour which extends approximately along the contour of the crown portion 3 and a crown main body 21 which essentially covers the opening 12 of the head main body 10. To help readers understanding, the contour of the crown main body 21 is illustrated with a two dotted line.

The crown main body 21 may be provided around its periphery with a face-side peripheral portion 22, a toe-side peripheral portion 23, a heel-side peripheral portion 24 and a back-side peripheral portion 25. In this embodiment, these peripheral portions 22 to 25 are joined to the mounting portion 13 of the head main body 10 using an adhesive agent.

The face-side peripheral portion 22 extends in the toe-heel direction of the head 1 on a face side of the crown member 20. The toe-side peripheral portion 23 is located backwardly of the club head with respect to the face-side peripheral portion 22, and extends along the contour of a toe side of the crown member 20. The heel-side peripheral portion 24 is located backwardly of the club head with respect to the face-side peripheral portion 22, and extends along the contour of a heel side of the crown member 20. The back-side peripheral portion 25 is located backwardly of the club head with respect to the face-side peripheral portion 22, and extends along the contour of a back side of the crown member 20. The toe-side peripheral portion 23 is continuous to the heel-side peripheral portion 24 through the back-side peripheral portion 25.

Figure 6A:
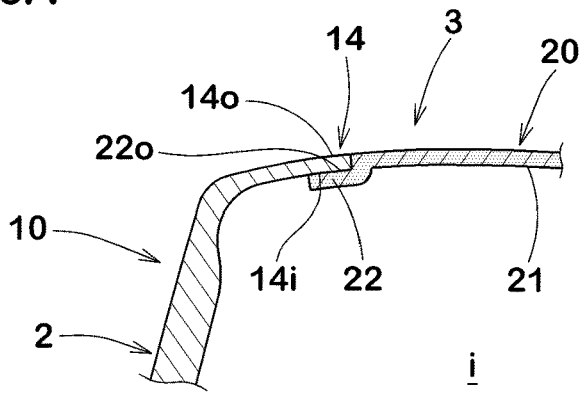
FIGS. 6A, 6B and 6C are cross-sectional views taken along lines A-A, B-B and C-C of FIG. 3, respectively.
Figure 6B:
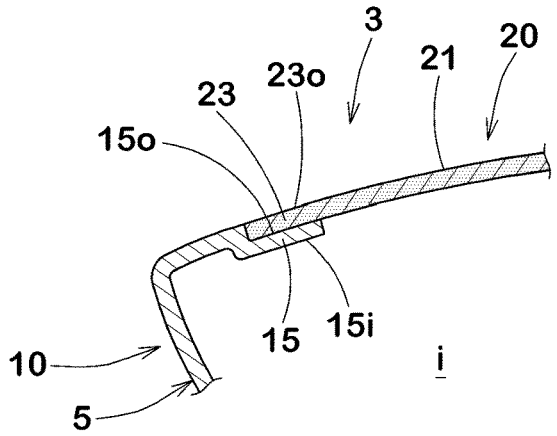
Figure 6C:
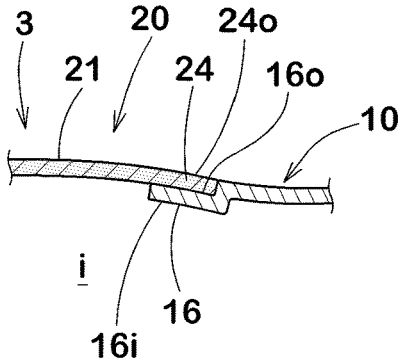

FIGS. 6A, 6B and 6C respectively illustrate cross-sectional views taken along the lines A-A, B-B and C-C of FIG. 3. As illustrated in FIG. 6A, the face-side peripheral portion 22 of the crown member 20 is joined to an interior surface 14*i*, which faces the hollow i, of the face-side mounting portion 14 of the head main body 10, but is not joined to the exterior surface 14*o* of the face-side mounting portion 14.

Generally, during the impact between the hitting face 2*a* of the club head 1 and a ball, a region of the crown portion 3 on the side of the hitting face 2*a* tends to deform elastically in such a manner as to protrude upwardly. In the club head 1 in accordance with the embodiment, since the face-side peripheral portion 22 of the crown member 20 is joined to the interior surface 14*i* of the face-side mounting portion 14 of the head main body 10, the face-side peripheral portion 22 of the crown member 20 is hardly separated from the head main body 10 even when the deformation of the head 1 as described above occurs.

On the other hand, as illustrated in FIG. 6B, the toe-side peripheral portion 23 of the crown member 20 is joined to the exterior surface 15*o* of the toe-side mounting portion 15 of the head main body 10. In this embodiment, the toe-side peripheral portion 23 is not joined to the interior surface 15*i* of the toe-side mounting portion 15. Similarly, as illustrated in FIG. 6C, the heel-side peripheral portion 24 of the crown member 20 is joined to the exterior surface 16*o* of the heel-side mounting portion 16 of the head main body 10. In this embodiment, the heel-side peripheral portion 24 is not joined to the interior surface 16*i* of the heel-side mounting portion 16.

In the club head 1 in accordance with the embodiment which is configured as described above, while the face-side peripheral portion 22 of the crown member 20 is restricted moving upwardly, the toe-side peripheral portion 23 and the heel-side peripheral portion 24 which are located backwardly of the face-side peripheral portion are restricted moving downwardly. Thus, apparent rigidity of the crown member 20 may be increased since a front side region of the crown member 20 is restrained from moving in the up and down direction of the head. Consequently, the crown member 20, at impact with a ball, may vibrate less, and then may provide higher hitting sound and/or longer reverberation sound to which many golfers prefer.

Figure 7:
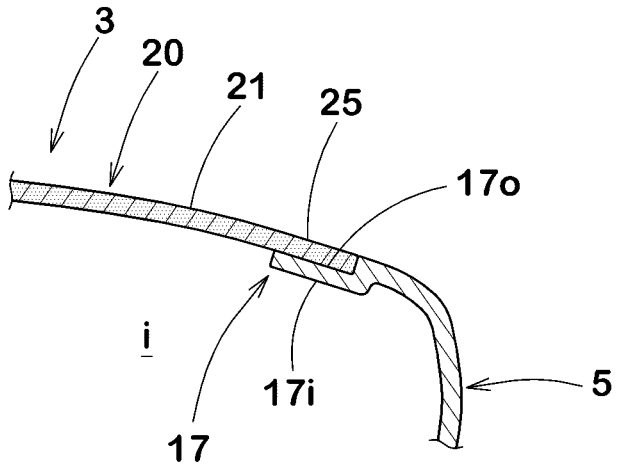
FIG. 7 is a cross-sectional view taken along lines D-D of FIG. 3.

FIG. 7 illustrates a cross-sectional view taken along the line D-D of FIG. 3. As illustrated in FIG. 7, in the head 1 according to the embodiment, the back-side peripheral portion 25 of the crown member 20 is joined to the exterior surface 17*o*, which faces the outside of the club head, of the back-side mounting portion 17 of the head main body 10. Since deformation of the crown portion 3 on a back side of the head at impact with a ball tends generally be small, the back-side peripheral portion 25 of the crown member 20 hardly separates from the head main body 10. Thus, it doesn't matter whether the back-side peripheral portion 25 is joined to the exterior surface 17*o* or the interior surface 17*i* of the back-side mounting portion 17. In another aspect, the back-side peripheral portion 25 of the crown member 20 may be joined to the interior surface 17*i* of the back-side mounting portion 17.

In some preferred embodiments, as illustrated in FIG. 6A, the exterior surface 22*o* of the face-side peripheral portion 22 of the crown member 20 is connected to the crown main body 21 through a step in such a manner that the exterior surface 22*o* thereof is located downwardly of the exterior surface of the crown main body 21. This aspect may be useful to finish up smoothly the exterior surface of the crown portion 3 since the level difference on the crown portion 3 formed between the exterior surfaces of the crown member 20 and the head main body 10 becomes small or substantially zero.

On the other hand, the toe-side mounting portion 15 and the heel-side mounting portion 16 of the head main body 10 are previously located downwardly from the finish up exterior surface of the crown portion 3 at a certain distance (e.g., the distance may preferably correspond to a thickness of the crown member 20.). As illustrated in FIGS. 6B, 6C, and 7, the toe-side peripheral portion 23 and the heel-side peripheral portion 24 are connected to the crown main body 21 such that the respective exterior surfaces 23*o* and 24*o* of the toe-side peripheral portion 23 and the heel-side peripheral portion 24 of the crown member 20 are smoothly continuous to the exterior surface of the crown main body 21.

As illustrated in FIG. 5A, a width W of the mounting portion 13 of the head main body 10, for example, may preferably be approximately in a range of from 2 to 10 mm in order to reduce in weight of the crown portion 3 while maintaining a sufficient junction area with the crown member 20.

The width W of the mounting portion 13 may be constant at any positions around the opening 12 or may vary. For example, at impact with a ball, the force acting on the crown portion 3 tends to be lowered toward a back side of the club head. Thus, as the mounting portion 13, the width of the back-side mounting portion 17 may be smaller than those of the toe-side mounting portion 15 and the heel-side mounting portion 16. In this aspect, a larger opening 12 may be provided on the crown portion 3 leading to lower center of gravity while maintaining high durability of the head 1.

In some preferred embodiments, the mounting portion 13 may include a portion in which the width W reduces gradually toward the back side of the club head. Furthermore, in some preferred embodiments, the portion having the width W reducing toward the back side may be provided in at least a region located backwardly of the center of gravity G of the head 1.

Figure 8:
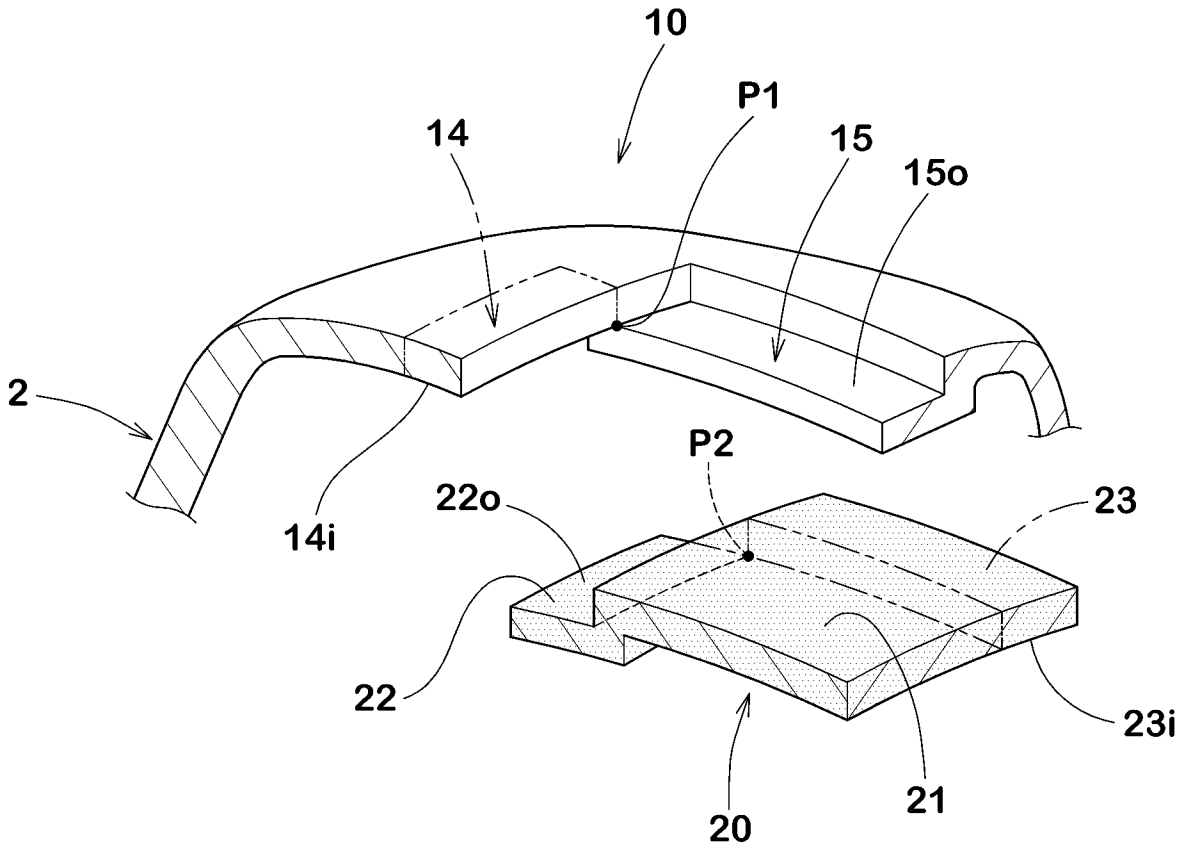
FIG. 8 is an exploded perspective view of the head main body and the crown member, as viewed from arrow A of FIG. 5A.

FIG. 8 is an exploded perspective view of the head main body 10 and the crown member 20, as viewed from the arrow A of FIG. 5A. In some preferred embodiments, as illustrated in FIG. 5A and FIG. 8, the face-side mounting portion 14 and the toe-side mounting portion 15 of the head main body 10 are substantially continuous at a connecting position P1 without a gap. In this embodiment, the interior surface 14*i* of the face-side mounting portion 14 and the exterior surface 15*o* of the toe-side mounting portion 15 are continuous in such a manner that both surfaces 14*i* and 15*o* form substantially the same surface at the connecting position P1, e.g., this position P1 may be substantially a point.

As a related structure to the above head main body 10, in the crown member 20, the face-side peripheral portion 22 and the toe-side peripheral portion 23 are continuous at a connecting position P2 without a gap. In this embodiment, the exterior surface 22*o* of the face-side peripheral portion 22 and the interior surface 23*i* of the toe-side peripheral portion 23 are continuous in such a manner that both surfaces 22*o* and 23*i* form substantially the same surface at the connecting position P2, e.g., this position may be substantially a point. Thus, in the plan view of the crown member 20 as illustrated in FIG. 5B, an internal corner portion with a corner point located at the connecting position P2 is formed between the face-side peripheral portion 22 and the toe-side peripheral portion 23.

By joining the exterior surface 22*o* of the face-side peripheral portion 22 of the crown member 20 to the interior surface 14*i* of the face-side mounting portion 14, and joining the interior surface 23*i* of the toe-side peripheral portion 23 of the crown member 20 to the exterior surface 15*o* of the toe-side mounting portion 15, the connecting position P2 of the crown member 20 is placed substantially on the connecting position P1 of the head main body 10. Since the internal corner portion of the crown member 20 formed between the face side and the toe side may substantially be supported continuously by the mounting portion 13 of the head main body 10, the structure as described above may offer high joining strength, leading to high durability of the head 1.

Figure 9:
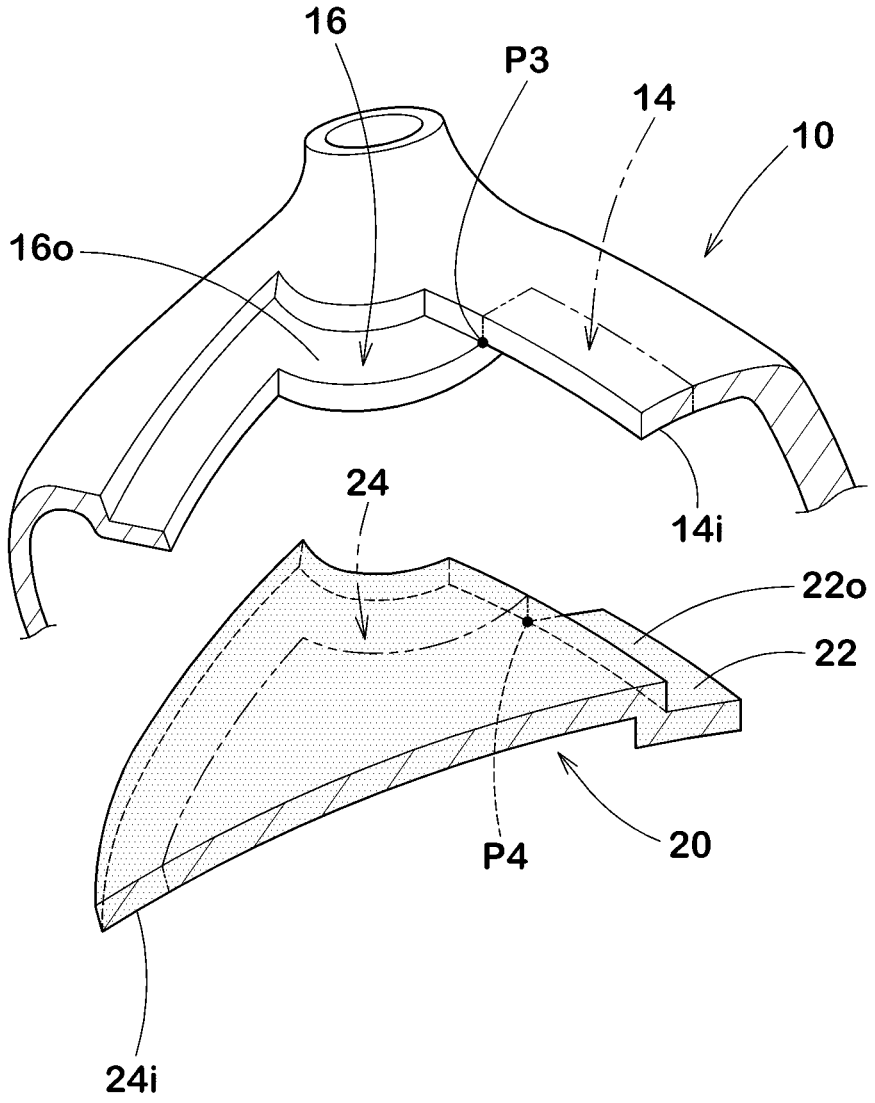
FIG. 9 is an exploded perspective view of the head main body and the crown member viewed from arrow B of FIG. 5A.

Similarly, FIG. 9 illustrates an exploded perspective view of the head main body 10 and the crown member 20 viewed from the arrow B of FIG. 5A. In some preferred embodiments, as illustrated in FIG. 5A and FIG. 9, the face-side mounting portion 14 and the heel-side mounting portion 16 of the head main body 10 are continuous at a connecting position P3 without a gap. In this embodiment, the interior surface 14*i* of the face-side mounting portion 14 and the exterior surface 16*o* of the heel-side mounting portion 16 are continuous in such a manner that both surfaces 14*i* and 16*o* form substantially the same surface at the connecting position P3, e.g., this position may be substantially a point.

As a related structure to the above head main body 10, in the crown member 20, the face-side peripheral portion 22 and the heel-side peripheral portion 24 are continuous at a connecting position P4 without a gap. In this embodiment, the exterior surface 22*o* of the face-side peripheral portion 22 and the interior surface 24*i* of the heel-side peripheral portion 24 are continuous in such a manner that both surfaces 22*o* and 24*i* form substantially the same surface at the connecting position P4, e.g., this position may be substantially a point. Thus, in the plan view of the crown member 20 as illustrated in FIG. 5B, an internal corner portion with a corner point located at the connecting position P4 is formed between the face-side peripheral portion 22 and the heel-side peripheral portion 24.

By joining the exterior surface 22*o* of the face-side peripheral portion 22 of the crown member 20 to the interior surface 14*i* of the face-side mounting portion 14, and joining the interior surface 24*i* of the heel-side peripheral portion 24 of the crown member 20 to the exterior surface 16*o* of the heel-side mounting portion 16, the connecting position P4 of the crown member 20 is placed substantially on the connecting position P3 of the head main body 10. Since the internal corner portion of the crown member 20 formed between the face side and the heel side may substantially be supported continuously by the mounting portion 13 of the head main body 10, the structure as described above may offer further high joining strength, leading to high durability of the head 1.

In some preferred embodiments, as illustrated in FIG. 5A, FIG. 8 and FIG. 9, the head main body 10 may include the face-side mounting portion 14, the toe-side mounting portion 15, the heel-side mounting portion 16 and the back-side mounting portion 17 which are continuous with each other in a loop manner without a gap. As a related aspect of the crown member 20 to the above structure of the head main body, as illustrated in FIG. 5B, FIG. 8 and FIG. 9, the crown member 20 may also include the face-side peripheral portion 22, the toe-side peripheral portion 23, the heel-side peripheral portion 24 and the back-side peripheral portion 25 which are continuous with each other in a loop manner without a gap. In the above aspect, since the crown member 20 may be joined to the head main body 10 in a loop manner around the opening 12, the crown member 20 is firmly fixed to the head main body 10, leading to higher hitting sound and/or longer reverberation sound.

The connecting position P1 between the face-side mounting portion 14 and the toe-side mounting portion 15 as well as the connecting position P3 between the face-side mounting portion 14 and the heel-side mounting portion 16 are located backward at a distance D from the upper edge 2*e* of the hitting face 2*a*. When the distance D becomes smaller, a joined portion of the head main body 10 and the crown member 20 tends to approach the face portion 2, and which may lead to low durability of the head. On the other hand, when the distance D becomes greater, an area of the opening 12 tends to be small, and it may be difficult to offer low center of gravity of the head 1. In view of the above, the distance D may preferably be in a range of from 5 to 30 mm. Alternatively, the distance D may preferably be set in a range of from 4% to 50%, more preferably 4% to 40%, and further preferably 4% to 30% of a length (L) of the crown portion 3 in the front-back direction of the head, for example.

Next, some other embodiments now will be explained below. In the following embodiments, note that the same numerals are denoted to the same or related elements as described in the above embodiment, and explanation thereof are omitted herein.

Figure 10B:
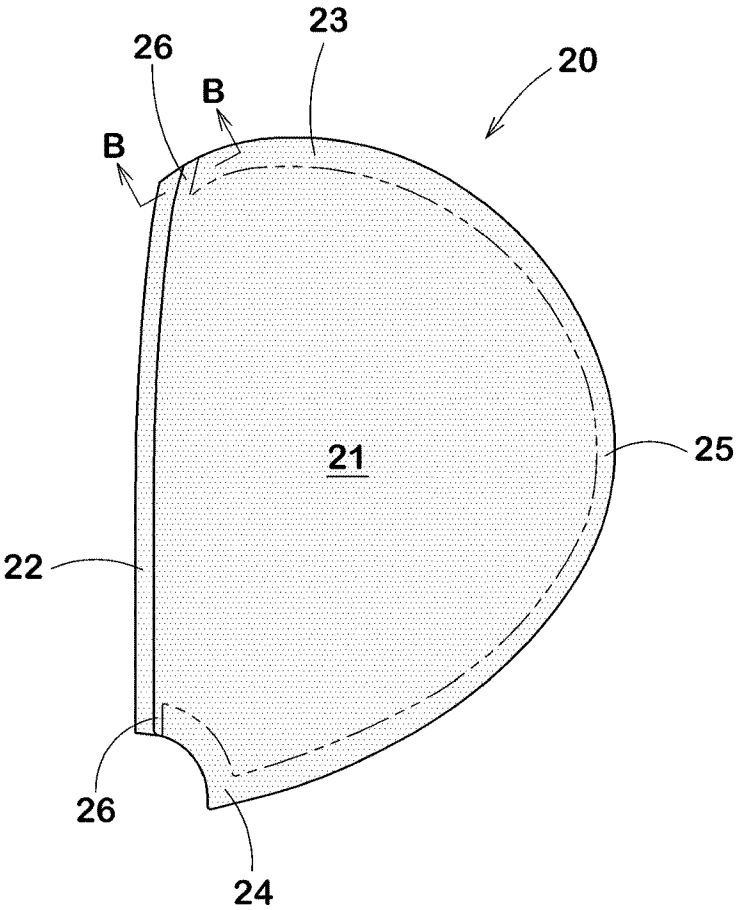
FIGS. 10A and 10B are plan views of the head main body and the crown member, respectively, in accordance with another embodiment.
Figure 10A:
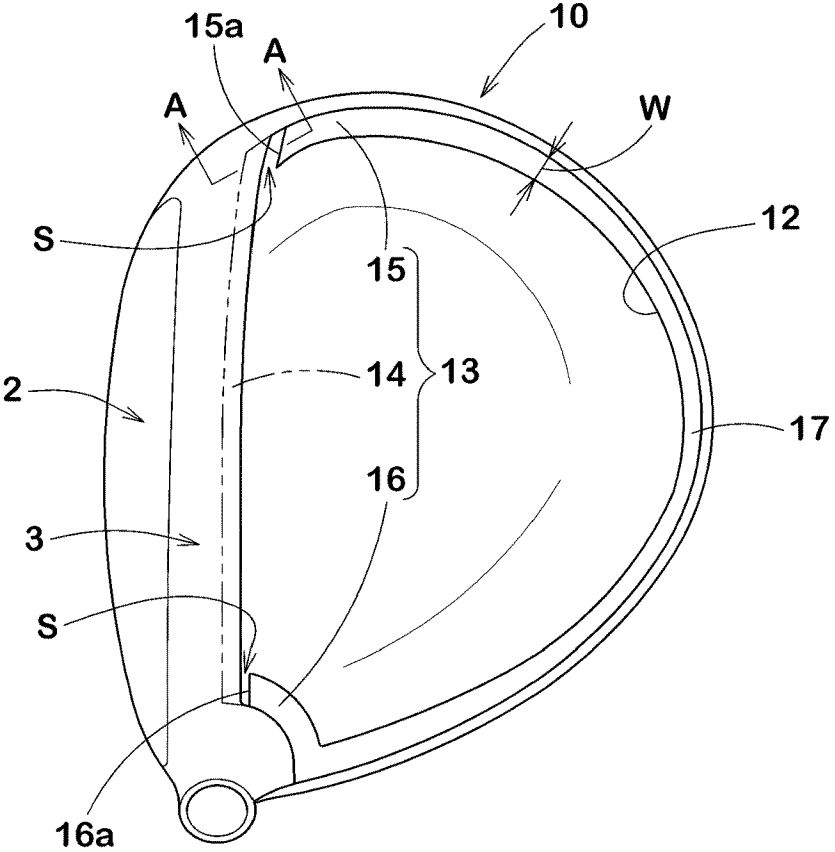
Figure 11A:
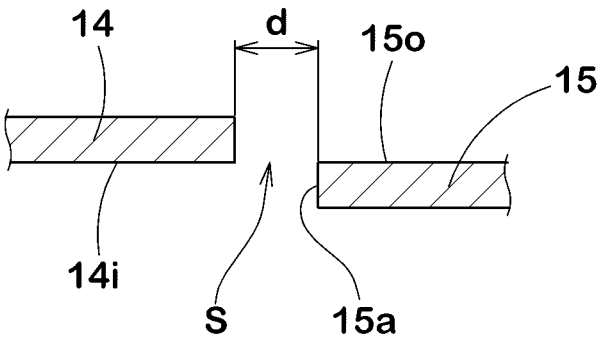
FIGS. 11A and 11B are cross-sectional views taken along lines A-A of FIG. 10A and lines B-B of FIG. 10B, respectively.

FIGS. 10A and 10B illustrate plan views of the head main body and the crown member, respectively, in accordance with another embodiment. Furthermore, FIGS. 11A and 11B are cross-sectional views taken along lines A-A of FIG. 10A and lines B-B of FIG. 10B, respectively.

In this embodiment, as illustrated in FIG. 10A, in the head main body 10, the face-side mounting portion 14 and the toe-side mounting portion 15 are not continuous with each other so as to have a gap S therebetween. Further, similar to the previous embodiment as illustrated in FIG. 11A, the toe-side mounting portion 15 is located downwardly of the face-side mounting portion 14. In some preferred aspects, the interior surface 14*i* of the face-side mounting portion 14 and the exterior surface 15*o* of the toe-side mounting portion 15 are arranged such that these surfaces 14*i* and 15*o* form a substantially single plane in the up and down direction.

In the same way, in the head main body 10, the face-side mounting portion 14 and the heel-side mounting portion 16 are not continuous with each other so as to have a gap S therebetween. In this embodiment, the heel-side mounting portion 16, as with the toe-side mounting portion 15, is located downwardly from the face-side mounting portion 14 (not illustrated).

Figure 11B:
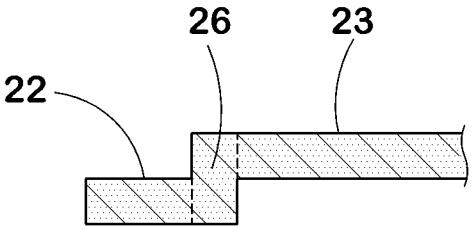

As illustrated in FIG. 10B and FIG. 11B, in the crown member 20, the face-side peripheral portion 22 is coupled to the toe-side peripheral portion 23 through a joint member 26. The face-side peripheral portion 22 is located downwardly of the toe-side peripheral portion 23, and the joint member 26 connects therebetween.

Figure 11C:
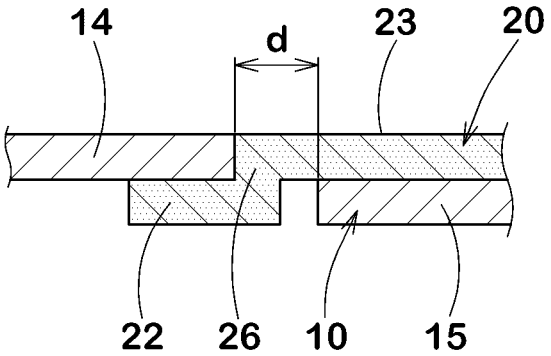
FIG. 11C is a cross-sectional view of a joined portion of the head main body and the crown member.

FIG. 11C illustrates a cross-sectional view of the head main body 10 and the crown member 20 which have already joined (i.e., the portion illustrated in FIG. 11A is joined to the portion illustrated in FIG. 11B). As it is clear from FIGS. 11A to 11C, the gap S formed between the face-side mounting portion 14 and the toe-side mounting portion 15 of the head main body 10 is closed by being arranged the joint member 26 of the crown member 20. Similarly, although it is not illustrated, the gap S formed between the face-side mounting portion 14 and the heel-side mounting portion 16 of the head main body 10 is also arranged the joint member 26 on the side of the heel side of the crown member 20. Thus, each of the gaps S is closed so that the opening 12 of the head main body 10 may completely be covered.

In this embodiment, while the face-side peripheral portion 22 of the crown member 20 is restricted moving upwardly, the toe-side peripheral portion 23 and the heel-side peripheral portion 24 which are located backwardly of the face-side peripheral portion are restricted moving downwardly. Thus, apparent rigidity of the crown member 20 may be increased since a front side region of the crown member 20 is restrained from moving in the up and down direction of the head. Consequently, the crown member 20, at impact with a ball, may vibrate less, and then may provide higher hitting sound and/or longer reverberation sound.

When distances d in the front-back direction of the gaps S of the head main body 10 become large, portions around the gaps S tends to be decreased in rigidity. In view of above, the distances d may preferably be equal to or less than 10 mm, more preferably equal to or less than 5 mm. On the other hand, the gaps S become excessively small, workability of installing the crown member 20 to the head main body 10 tends to be deteriorated, for example. In some preferred aspects, the distances d may be set in a certain range such that the face-side peripheral portion 22 of the crown member 20 can be inserted into the gaps S from outside the head 1 as well as being able to be arranged onto the interior surface of the face-side mounting portion 14.

While the particularly preferable embodiments in accordance with the present invention have been described in detail, the present invention is not limited to the illustrated embodiments, but can be modified and carried out in various aspects.

WORKING EXAMPLE

In order to verify effects of the present disclosure, some golf club heads with a head volume of 460 cc having the head main body made of a titanium alloy and the crown members made of CFRP were manufactured, and then durability, and frequency and reverberation time of hitting sound of each golf club head were tested. The golf club heads included three kinds that differ in only a joined structure as follows:

Comparative Example

The golf club head according to comparative example had a structure of FIG. 1, but an interior surface of the entire peripheral portion of the crown member was joined to an exterior surface of the mounting portion of the head main body with the distances D of 10 mm.

Example 1

The golf club head according to example 1 had a structure as shown in FIGS. 1 to 9 with the distances D of 10 mm.

Example 2

The golf club head according to example 2 had a structure as shown in FIG. 10 with the distances d of the gaps S and the distances D of 10 mm.

[Test for Durability of Golf Club Head]

Golf clubs were manufactured by mounting a club shaft made of CFRP into the above golf club heads, and then a hitting test was conducted using a swing robot and the golf clubs by hitting a ball repeatedly at a swing speed of 54 m/s. During the hitting test where the number of maximum shots was set to 10000, a joining condition of the crown member was checked at every 500 shots. The number of shots when a separation of the crown member was found was evaluated as durability of the golf club head. The larger the number, the better the durability is.

[Test for Frequency and Reverberation Time of Hitting Sound]

First, using the above each golf club and the swing robot, each hitting sound of the golf club head when hitting a ball at the center of the hitting face at a head speed of 35 m/s was collected with a sound level meter. Next, frequency response functions were derived from the collected hitting sounds using an FFT analyzer. Next, primary peak of the frequency was obtained from the frequency response functions. There is a tendency that the larger the frequency, the higher the hitting sound is. Further, reverberation time of hitting sound was evaluated using wavelet analysis. The larger the value, the longer the reverberation time is.

TABLE 1

| | Comparative example | Ex. 1 | Ex. 2 |
|---|---|---|---|
| Durability (number of shots) | 1500 | 10000 | 9500 |
| Frequency of hitting sound (Hz) | 2800 | 3600 | 3550 |
| Reverberation time of hitting sound (ms) | 16 | 20.5 | 20 |

From the test results, it is confirmed that examples 1-2 have excellent durability and generate high frequency hitting sound with long reverberation time as compared with comparative example.

What is claimed is:

1. A golf club head having a hollow therein, the golf club head comprising:

a head main body; and a crown member;

the head main body comprising a face portion having a hitting face for striking a ball, a crown portion provided with only a single opening and a peripheral region forming around the opening, wherein the opening is covered with the crown member, the peripheral region of the opening comprising a mounting portion for mounting the crown member, the mounting portion having an interior surface and an exterior surface thereof, the mounting portion, at least, comprising a face-side mounting portion extending in a toe-heel direction of the golf club head on a side of the face portion of the peripheral region, a toe-side mounting portion extending on a toe side of the golf club head of the peripheral region and located backwardly of the face-side mounting portion in a front-back direction of the golf club head, and a heel-side mounting portion extending on a heel side of the golf club head of the peripheral region and located backwardly of the face-side mounting portion in the front-back direction of the golf club head, wherein the face-side mounting portion and the toe-side mounting portion are continuous with each other at a point (P1), the point (P1) is located backwardly of an upper edge of the hitting face at a distance (D) in the front-back direction of the golf club head, and the distance (D) is in a range of from 4% to 50% of a length (L) of the crown portion in the front-back direction of the golf club head; and the crown member comprising a face-side peripheral portion fixed to the interior surface of the face-side mounting portion, a toe-side peripheral portion fixed to the exterior surface of the toe-side mounting portion and a heel-side peripheral portion fixed to the exterior surface of the heel-side mounting portion.

2. The golf club head according to claim 1, wherein the face-side mounting portion and the toe-side mounting portion are continuous at a point (P1), the point (P1) is located backwardly of an upper edge of the hitting face at a distance (D) in the front-back direction of the golf club head, and the distance (D) is in a range of from 5 to 30 mm.

3. The golf club head according to claim 1, wherein the face-side mounting portion and the heel-side mounting portion are continuous with each other.

4. The golf club head according to claim 3, wherein the face-side mounting portion and the heel-side mounting portion are continuous at a point (P3), the point (P3) is located backwardly of an upper edge of the hitting face at a distance (D) in the front-back direction of the golf club head, and the distance (D) is in a range of from 4% to 50% of a length (L) of the crown portion in the front-back direction of the golf club head.

5. The golf club head according to claim 3, wherein the face-side mounting portion and the heel-side mounting portion are continuous at a point (P3), the point (P3) is located backwardly of an upper edge of the hitting face at a distance (D) in the front-back direction of the golf club head, and the distance (D) is in a range of from 5 to 30 mm.

6. The golf club head according to claim 5, wherein in a plan view of the golf club head, the crown member comprises an internal corner portion with a corner point formed between the face-side peripheral portion and the heel-side peripheral portion, and the corner point is placed substantially on the point (P3).

7. The golf club head according to claim 1, the mounting portion further comprising a back-side mounting portion extending on a back side of the golf club head of the peripheral region, the crown member further comprising a back-side peripheral portion fixed to the exterior surface of the back-side mounting portion, and the face-side mounting portion, the toe-side mounting portion, the heel-side mounting portion and the back-side mounting portion are continuous with each other in a loop manner.

8. The golf club head according to claim 1, wherein in a plan view of the golf club head, a gap in the front-back direction of the golf club head is formed either between the face-side mounting portion and the toe-side mounting portion so that the face-side mounting portion and the toe-side mounting portion are separated from each other, or between the face-side mounting portion and the heel-side mounting portion so that the face-side mounting portion and the heel-side mounting portion are separated from each other, and the gap is in communication with the opening.

9. The golf club head according to claim 8, wherein the gap has a distance in the front-back direction of the golf club head in a range of from 3 to 10 mm.

10. The golf club head according to claim 1, wherein in a plan view of the golf club head, the crown member comprises an internal corner portion with a corner point formed between the face-side peripheral portion and the toe-side peripheral portion.

11. The golf club head according to claim 1, wherein in a plan view of the golf club head, the crown member comprises an internal corner portion with a corner point formed between the face-side peripheral portion and the toe-side peripheral portion, and the corner point is placed substantially on the point (P1).

12. The golf club head according to claim 1, wherein in a plan view of the golf club head, the crown member comprises an internal corner portion with a corner point formed between the face-side peripheral portion and the heel-side peripheral portion.

13. The golf club head according to claim 1, wherein the face-side mounting portion is a portion that extends from an opening edge of the opening toward the striking face.

14. A golf club head having a hollow therein, the golf club head comprising:

a head main body; and a crown member;

the head main body comprising a face portion having a hitting face for striking a ball, a crown portion provided with only a single opening and a peripheral region forming around the opening, wherein the opening is covered with the crown member, the peripheral region of the opening comprising a mounting portion for mounting the crown member, the mounting portion having an interior surface and an exterior surface thereof, the mounting portion, at least, comprising a face-side mounting portion extending in a toe-heel direction of the golf club head on a side of the face portion of the peripheral region, a toe-side mounting portion extending on a toe side of the golf club head of the peripheral region and located backwardly of the face-side mounting portion in a front-back direction of the golf club head, and a heel-side mounting portion extending on a heel side of the golf club head of the peripheral region and located backwardly of the face-side mounting portion in the front-back direction of the golf club head, wherein the face-side mounting portion and the toe-side mounting portion are continuous with each other at a point (P1), the point (P1) is located backwardly of an upper edge of the hitting face at a distance (D) in the front-back direction of the golf club head, and the distance (D) is in a range of from 5 to 30 mm; and the crown member comprising a face-side peripheral portion fixed to the interior surface of the face-side mounting portion, a toe-side peripheral portion fixed to the exterior surface of the toe-side mounting portion and a heel-side peripheral portion fixed to the exterior surface of the heel-side mounting portion.

15. A golf club head having a hollow therein, the golf club head comprising:

a head main body; and a crown member;

the head main body comprising a face portion having a hitting face for striking a ball, a crown portion provided with only a single opening and a peripheral region forming around the opening, wherein the opening is covered with the crown member, the peripheral region of the opening comprising a mounting portion for mounting the crown member, the mounting portion having an interior surface and an exterior surface thereof, the mounting portion, at least, comprising a face-side mounting portion extending in a toe-heel direction of the golf club head on a side of the face portion of the peripheral region, a toe-side mounting portion extending on a toe side of the golf club head of the peripheral region and located backwardly of the face-side mounting portion in a front-back direction of the golf club head, and a heel-side mounting portion extending on a heel side of the golf club head of the peripheral region and located backwardly of the face-side mounting portion in the front-back direction of the golf club head, wherein the face-side mounting portion and the heel-side mounting portion are continuous with each other at a point (P3), the point (P3) is located backwardly of an upper edge of the hitting face at a distance (D) in the front-back direction of the golf club head, and the distance (D) is in a range of from 4% to 50% of a length (L) of the crown portion in the front-back direction of the golf club head; and the crown member comprising a face-side peripheral portion fixed to the interior surface of the face-side mounting portion, a toe-side peripheral portion fixed to the exterior surface of the toe-side mounting portion and a heel-side peripheral portion fixed to the exterior surface of the heel-side mounting portion.

16. A golf club head having a hollow therein, the golf club head comprising:

a head main body; and a crown member;

the head main body comprising a face portion having a hitting face for striking a ball, a crown portion provided with only a single opening and a peripheral region forming around the opening, wherein the opening is covered with the crown member, the peripheral region of the opening comprising a mounting portion for mounting the crown member, the mounting portion having an interior surface and an exterior surface thereof, the mounting portion, at least, comprising a face-side mounting portion extending in a toe-heel direction of the golf club head on a side of the face portion of the peripheral region, a toe-side mounting portion extending on a toe side of the golf club head of the peripheral region and located backwardly of the face-side mounting portion in a front-back direction of the golf club head, and a heel-side mounting portion extending on a heel side of the golf club head of the peripheral region and located backwardly of the face-side mounting portion in the front-back direction of the golf club head, wherein the face-side mounting portion and the heel-side mounting portion are continuous with each other at a point (P3), the point (P3) is located backwardly of an upper edge of the hitting face at a distance (D) in the front-back direction of the golf club head, and the distance (D) is in a range of from 5 to 30 mm; and the crown member comprising a face-side peripheral portion fixed to the interior surface of the face-side mounting portion, a toe-side peripheral portion fixed to the exterior surface of the toe-side mounting portion and a heel-side peripheral portion fixed to the exterior surface of the heel-side mounting portion.

17. A golf club head having a hollow therein, the golf club head comprising:

a head main body; and a crown member;

the head main body comprising a face portion having a hitting face for striking a ball, a crown portion provided with only a single opening and a peripheral region forming around the opening, wherein the opening is covered with the crown member, the peripheral region of the opening comprising a mounting portion for mounting the crown member, the mounting portion having an interior surface and an exterior surface thereof, the mounting portion, at least, comprising a face-side mounting portion extending in a toe-heel direction of the golf club head on a side of the face portion of the peripheral region, a toe-side mounting portion extending on a toe side of the golf club head of the peripheral region and located backwardly of the face-side mounting portion in a front-back direction of the golf club head, and a heel-side mounting portion extending on a heel side of the golf club head of the peripheral region and located backwardly of the face-side mounting portion in the front-back direction of the golf club head; and the crown member comprising a face-side peripheral portion fixed to the interior surface of the face-side mounting portion, a toe-side peripheral portion fixed to the exterior surface of the toe-side mounting portion and a heel-side peripheral portion fixed to the exterior surface of the heel-side mounting portion, wherein in a plan view of the golf club head, a gap in the front-back direction of the golf club head is formed either between the face-side mounting portion and the toe-side mounting portion so that the face-side mounting portion and the toe-side mounting portion are separated from each other, or between the face-side mounting portion and the heel-side mounting portion so that the face-side mounting portion and the heel-side mounting portion are separated from each other, and the gap is in communication with the opening.

* * * * *